United States Patent [19]

Jeffrey et al.

[11] 4,043,931

[45] Aug. 23, 1977

[54] LAVATORY CLEANSING BLOCK

[75] Inventors: Daniel John Jeffrey, East Harling; Keith Charles Gingell, Roydon, near Diss, both of England

[73] Assignee: Jeyes Group Limited, Thetford, England

[21] Appl. No.: 443,529

[22] Filed: Feb. 19, 1974

[30] Foreign Application Priority Data

Feb. 26, 1973 United Kingdom ..... 9329/73

[51] Int. Cl.[2] ..... C11D 1/10; C11D 1/48

[52] U.S. Cl. ..... 252/93; 134/42; 252/89 R; 252/90; 252/106; 252/548

[58] Field of Search ..... 252/DIG. 16, 106, 107, 252/174, 89, 548, 90; 424/76, 78; 4/222, 228; 210/64

[56] References Cited

U.S. PATENT DOCUMENTS

| | | | |
|---|---|---|---|
| 3,272,899 | 9/1966 | Diamond et al. | 264/126 |
| 3,277,009 | 10/1966 | Freifeld et al. | 252/90 |
| 3,300,546 | 1/1967 | Baechtold | 260/876 |
| 3,378,495 | 4/1968 | Buck | 252/107 |
| 3,504,384 | 4/1970 | Radley et al. | 4/228 |
| 3,538,520 | 11/1970 | Leavitt | 4/222 |
| 3,545,014 | 12/1970 | Davis | 4/228 |
| 3,760,429 | 9/1973 | Brownstein | 4/109 |
| 3,897,357 | 7/1975 | Carmello et al. | 252/106 |

FOREIGN PATENT DOCUMENTS

| | | |
|---|---|---|
| 2,162,790 | 7/1972 | Germany |
| 30,706 | 10/1970 | Japan |
| 897,733 | 5/1962 | United Kingdom |
| 599,542 | 3/1948 | United Kingdom |

*Primary Examiner*—P.E. Willis, Jr.
*Attorney, Agent, or Firm*—Stevens, Davis, Miller & Mosher

[57] ABSTRACT

A lavatory cleansing block comprises a solid carrier base which is a mixture of two or more non-ionic surface active agents, one of which is relatively insoluble in water and the other of which is relatively soluble in water and preferably also contains one or more of (i) perfuming agents, (ii) coloring constituents, (iii) germicides, (iv) builders or fillers and (v) water-softening agents.

7 Claims, No Drawings

LAVATORY CLEANSING BLOCK

This invention is concerned with improvements in and relating to cleansing blocks for lavatories. In particular this invention is concerned with a cleansing block of the type for immersion in the cistern of a lavatory (which term is also intended to include urinals) so that when the lavatory is flushed with water from the cistern the flush water contains some detergent or cleansing agent. Optionally, the block may also supply to the flush water one or more of colouring agents, perfumes, germicides and/or water softening agents.

Commonly, such cleansing blocks immersed in the cistern are contained in a suitable container so that the blocks are not eroded away too quickly and a more or less metered dose of detergent and/or other attribute is released to the flush water.

Clearly the convenience to the user could be increased, if the block could be introduced into the cistern without the need for a fabricated container. This invention, therefore, relates to such a block which may be placed in the cistern unwrapped or wrapped in some water soluble material.

It is thus an object of the present invention to provide a sustained release cleansing block for immersion in lavatory cisterns; that is a block which will gradually release its ingredients into the water in the cistern and the block is thereby slowly eroded away. Clearly it is desirable that the block should have a certain minimum life, say two weeks, since otherwise the user would have to replace the block too frequently. On the other hand the block should not erode too slowly since under these conditions the amount of active agent released from it would be insufficient to give the desired effects.

The blocks in accordance with the invention (and in common with other blocks of a similar sort) contain as principal ingredient a non-ionic detergent system which imparts cleansing and foaming properties. Additionally they may contain one or more of the following constituents, (i) a perfuming agent, (ii) a colouring constituent which is a dyestuff or other colouring agent, (iii) a germicide, (iv) a builder or filler and (v) a water softening agent (which helps to reduce build up of hard water scale).

The present invention is based on the discovery that sustained release of the ingredients of a block may be achieved by combining the use of a solid base comprising at least two non-ionic surface active agents, one of which is relatively insoluble in water and the other of which is relatively soluble.

Accordingly, in one embodiment, the present invention provides a lavatory cleansing block comprising a solid carrier base which is a mixture of two or more non-ionic surface active agents, one of which is relatively insoluble in water (i.e. has a solubility of $<0.01\%$ to 0.5% at 20° C) and the other which is relatively soluble in water (i.e. has a solubility of 1–100% at 20° C).

Suitable relatively water-insoluble non-ionic surface active agents for use in the composition of the invention are the mono - and dialkanolamides of long chain fatty acids which are solid at room temperature, and polyalkoxylated fatty alcohols containing up to 6 moles of alkoxide.

The alkanolamides may be represented by the formula

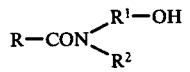

in which R is a long chain aliphatic group, containing for example 8–24, preferably 12–18 carbon atoms; $R^1$ is a lower alkylene group especially an ethylene or propylene group; and $R^2$ is a hydrogen atom or a group-$R^1OH$. Examples of suitable alkanolamides for use in the block are lauryl diethanolamide, coconut monoethanolamide and tallow monoethanolamide.

Suitable relatively soluble non-ionic surface active agents for use in the invention are polyalkoxylated fatty alcohols containing more than 6 alkyleneoxy units per molecule, and alkylene-oxy block copolymers such as ethyleneoxypropyleneoxy block copolymers. Particular examples of suitable relatively soluble surface active agents are 50 ethoxylated cetostearyl alcohol, 50 ethoxylated tallow alcohols and monolan 8,000, a commercially available block copolymer which is highly alkoxylated copolymer of polyethylene glycol MW 8,000.

The total surface active component content of the compositions according to the invention may cover a wide range and may be from 10 to 100% by weight, preferably at least 35% by weight. The degree of the release of the components from the block will be to a large extent, controlled by the relative proportions of relatively soluble and relatively insoluble non-ionic surface active components and their exact physical and chemical properties, e.g. molecular weight. In this connection it should be noted that whilst the invention must contain at least two surfactants, it is often desirable that they should contain three or more surfactants since by suitable combinations of various surfactants varying degrees of release can be obtained.

As stated above, the blocks of the invention will desirably contain other active ingredients, especially perfumes and/or dyestuffs, which other ingredients will be mixed with or dispersed in the solid carrier base. In this case the block may suitably contain up to 90% by weight of carrier base and the perfume content of the blocks of the invention may be up to 30% by weight and is suitably from 1–20% by weight, preferably about 10% by weight. Suitable perfume systems for use in the composition of the invention are bornyl acetate. International Flavours and Fragrances Perfume No. 8817 and the perfume Conifer 65,008 manufactured by Aromatica Ltd, these latter being commercially available perfumes.

The dyestuff used in the blocks of the invention may form up to 20% by weight of the composition, preferably from 1–10% by weight of the composition. The principal importance of the dyestuff besides imparting a pleasant colour to the water is to indicate to the user that the block is still present in the cistern, i.e. when the flush water becomes clear then the block is exhausted. This dye is suitably of a blue colouration and may be Lissamine Turquoise or Chlorazol Blue for example.

The compositions of the invention may also contain other ingredients in particular germicides such as Cetrimide B.P., Benzalkonium Chloride B.P., Ortho-phenyl phenol or ortho-benzyl-para-chloro-phenol.

The germicide is suitably present up to the amount of 25% by weight preferably in an amount of 1–10% by weight. Further the composition may include fillers. These are materials, generally of an inorganic nature, serving mainly to increase the bulk of the block without contributing in any great measure to the properties thereof. In this connection, however, it should be noted that one particular class of filler which would be preferred are those which impart water softening properties to the block such as the alkali metal polyphosphates and carbonates. Examples of fillers which may be incorporated in amounts of up to 60% by weight, preferably about 20% by weight, are alkali metal polyphosphates, carbonates, borates, bicarbonates, chlorides and sulphates, carboxymethyl celluloses, polyvinyl alcohol, clays and siliceous earths.

As mentioned above certain fillers, i.e. the polyphosphates may also act as water-softening agents, but of course, other water softening agents which do not act as fillers may be used in the blocks of the invention, for example ethylene diamine tetra-acetic acids or its alkali metal salts.

The composition of the invention may be prepared by mixing the ingredients in a suitable order and subsequently forming the mixture into shaped tablets which will suitably contain from 20–150 gms., preferably 30–70 gms., of active ingredient.

In order to facilitate handling of blocks they can be arranged in a protective envelope of water soluble substance (such as polyvinyl alcohol) which is dissolved away when the coated block is immersed in water.

In order that the invention may be well understood, the following examples are given by way of illustration only.

EXAMPLES

Blocks weighing about 50 gms. are made from the following three compositions:

| | | | |
|---|---|---|---|
| Bornyl Acetate | 8.0 | 8.0 | — |
| Aromatica Conifer 65008 | 2.0 | 2.0 | — |
| IFF 8817 | — | — | 10.0 |
| Lissamine Turquoise VN150 | 3.5 | 3.5 | 3.5 |
| Lauryl Diethanolamide | 20.0 | 26.1 | 19.0 |
| Coco. mono-ethanolamide | 20.0 | 26.1 | 19.0 |
| 50 moles. ethoxylated C/S alcohol | 20.5 | 26.7 | 17.5 |
| Calgon | 20.0 | — | 30.0 |
| Cetrimide | 1.0 | 1.0 | 1.0 |
| PEG 8000 copolymer alkoxylate | 5.0 | 6.6 | — |

Each of these blocks, when immersed in a domestic toilet cistern provided its active ingredients to the water, as evidenced by a blue colouration thereof, for about a month.

We claim:

1. A lavatory cleansing block comprising at least 35% of a solid carrier base which consists essentially of a mixture of at least two non-ionic surface active agents, one of which has a water solubility of 0.01 to 0.5% at 20° C. and is a mono- or dialkanolamide of a long chain fatty acid of the formula:

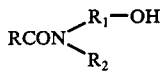

in which R is a long chain aliphatic group of from 8–24 C atoms, $R_1$ is a lower alkylene group and $R_2$ is a hydrogen atom or R'OH and the other of which has a water solubility of 1–100 at 20° C., the degree of release of components from the block being to a large extent controlled by the relative properties of relatively soluble and relatively insoluble non-ionic surface active components.

2. A block as claimed in claim 1 in which the surface active agent of higher water solubility is a polyalkoxylated fatty alcohol containing more than 6 ethyleneoxy units per molecule or an ethyleneoxy or propyleneoxy block copolymer.

3. A block as claimed in claim 1 also containing at least one of (i) up to 30% by weight of perfuming agents, (ii) up to 20% by weight of colouring constituents, (iii) up to 25% by weight of germicides and (iv) up to 60% by weight of fillers.

4. A block as claimed in claim 1 having a weight of from 20 to 150 grams.

5. A block as claimed in claim 1 having a weight of from 30 to 70 grams.

6. A block as claimed in claim 1 contained in a protective envelope of polyvinyl alcohol.

7. A method of cleaning a lavatory which comprises inserting into the water cistern thereof a lavatory cleaning block comprising at least 35% of a solid carrier base which consists essentially of a mixture of at least two nonionic surface active agents, one of which has a water solubility of 0.01 to 0.5% at 20° C. and is a mono- or dialkanolamide of a long chain fatty acid of the formula:

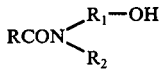

in which R is a long chain aliphatic group of from 8–24 C atoms, $R_1$ is a lower alkylene group and $R_2$ is a hydrogen atom of R'OH and the other of which has a water solubility of 1–100 at 20° C., the degree of release of components from the block being to a large extent controlled by the relatively soluble and relatively insoluble non-ionic surface active components.

* * * * *